US009643405B1

(12) United States Patent
Calamita

(10) Patent No.: US 9,643,405 B1
(45) Date of Patent: May 9, 2017

(54) SYSTEM AND METHOD FOR ALIGNING IMAGES ON MEDIA OR PLATENS

(71) Applicant: Xerox Corporation, Norwalk, CT (US)

(72) Inventor: James P. Calamita, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/224,941

(22) Filed: Aug. 1, 2016

(51) Int. Cl.
*B41J 11/42* (2006.01)
*B41J 2/045* (2006.01)
*B41J 2/21* (2006.01)

(52) U.S. Cl.
CPC ..... *B41J 2/04505* (2013.01); *B41J 2/04586* (2013.01); *B41J 2/2132* (2013.01)

(58) Field of Classification Search
CPC B41J 2/04505; B41J 2/04586; B41J 2/04588; B41J 2/2132; B41J 11/42
See application file for complete search history.

(56) References Cited

U.S. PATENT DOCUMENTS 7,762,642 B2 * 7/2010 Fellingham ..... B41J 2/2132 347/16
2005/0179721 A1 8/2005 Jones et al.
2013/0102103 A1 4/2013 Cellere et al.

* cited by examiner

*Primary Examiner* — Thinh H Nguyen
(74) *Attorney, Agent, or Firm* — Maginot, Moore & Beck, LLP

(57) ABSTRACT

A printing system facilitates the registration of printheads in the system. The system includes a plurality of printheads, a planar member having at least three pins along a first edge of the planar member and a plurality of pins on a second edge of the planar member that is orthogonal to the first edge, a plurality of actuators, an optical imaging device, and a controller. The controller operates one of the printheads to form a registration target on the media sheet and processes image data of the planar member and the media sheet received from the optical imaging device to identify positions for the registration target and at least two of the three pins on the planar member. Error distances are identified from the positions for the registration target and the at least two pins on the edge of the planar member and are used to register the printheads.

18 Claims, 3 Drawing Sheets

SYSTEM AND METHOD FOR ALIGNING IMAGES ON MEDIA OR PLATENS

TECHNICAL FIELD

This document relates generally to printing systems, and more particularly, to the alignment of ejected material on planar surfaces in printing systems.

BACKGROUND

A typical full width printer uses one or more printheads. The printheads are arranged in one or more arrays to enable a solid line at a predetermined resolution to be formed across the width of a planar member. The planar member can be a sheet of media in inkjet image printers or a platen in three-dimensional (3D) object printers. Each printhead typically contains an array of individual nozzles for ejecting drops of ink or material across an open gap to the planar member to form an image or layer on the member. In each printhead, individual piezoelectric, thermal, or acoustic actuators generate mechanical forces that expel ink or material through an orifice or nozzle in response to an electrical voltage signal, sometimes called a firing signal. The amplitude, frequency, or duration of the signals affects the amount of ink ejected in each drop. A printhead controller generates firing signals with reference to electronic image data to eject a pattern of individual ink drops at particular locations on the image receiving surface. The individual datum corresponding to a single drop in the electronic data is called a pixel and the locations where the drops land are sometimes called "drop locations," "drop positions," or "pixels."

In order for the drop positions to correspond closely to the pixels in the electronic image data, the printheads must be registered with reference to the planar member and with reference to the other printheads in the printer. Registration of printheads is a process in which the printheads are operated to eject drops in a known pattern and then the printed image of the ejected drops is analyzed to determine the orientation of the printhead with reference to the planar member. In previously known printers, the registration process involved a human operator manually measuring a printed pattern position with reference to the edges of the planar member or by using an automated closed loop system that measured a distance of the printed pattern from a single fiducial mark on the planar member. The first registration method is susceptible to human error and the second method is subject to misidentifying the single fiducial mark as debris or other objects on the planar member that have an appearance that is similar to the single fiducial mark. Therefore, an image registration system and method that is not susceptible to human error or misidentification of the fiducial mark would be useful.

SUMMARY

A new printing system is configured with an image registration system that enables accurate registration of ejected material to a planar member without the limitations of previously known registration systems. The printing system includes a plurality of printheads, each printhead being configured to eject drops of material, a planar member having at least three pins along a first edge of the planar member and a plurality of pins on a second edge of the planar member that is orthogonal to the first edge, a plurality of actuators operatively connected to the printheads and to the planar member to enable the actuators to move the planar member bi-directionally in a process direction with reference to the plurality of printheads and to move the printheads bi-directionally in a cross-process direction, an optical imaging device configured to generate image data of the planar member as the planar member passes the optical imaging device, and a controller operatively connected to the plurality of printheads, the optical imaging device, and the actuators. The controller is configured to operate one of the actuators to move the planar member past the array of printheads and to operate one of the printheads in the plurality of printheads to eject drops of material onto a media sheet that has one edge against the plurality of pins on the second edge of the planar member and has another edge that is adjacent the one edge of the media sheet and proximate the first edge of the planar member as the planar member passes the printheads to form a collection of material drops having a circular shape on the media sheet, to receive image data of the planar member and the media sheet from the optical imaging device as the planar member and media sheet pass the optical imaging device, to identify from the image data received from the optical imaging device positions for the collection of material drops and for at least two of the pins on the first edge of the planar member, and to identify a process direction error distance and a cross-process direction error distance with reference to the positions for the collection of material drops and the at least two pins on the first edge of the planar member.

A new method of operating a printing system configured with an image registration system enables accurate registration of ejected material to a planar member without the limitations of previously known registration systems. The method includes operating with a controller one of a plurality of actuators to move a planar member past an array of printheads, operating with the controller one of a plurality of printheads to eject drops of material onto a media sheet that has one edge against a plurality of pins on a first edge of the planar member and has another edge that is adjacent the one edge of the media sheet and proximate a second edge of the planar member that is adjacent to the first edge of the planar member as the planar member passes the array of printheads to form a collection of material drops having a circular shape on the media sheet, generating image data of the planar member and the media sheet with an optical imaging device, receiving with the controller image data of the planar member and the media sheet from the optical imaging device as the planar member and media sheet pass the optical imaging device, identifying with the controller positions for the collection of material drops and for at least two pins on the second edge of the planar member that is parallel to the cross-process direction, and identifying with the controller a process direction error distance and a cross-process direction error distance with reference to the positions for the collection of material drops and the at least two pins on the second edge of the planar member.

BRIEF DESCRIPTION OF THE DRAWINGS

The foregoing aspects and other features of a printing system that accurately registers ejected material on planar members in the printing system are explained in the following description, taken in connection with the accompanying drawings.

DETAILED DESCRIPTION

Figure 1:
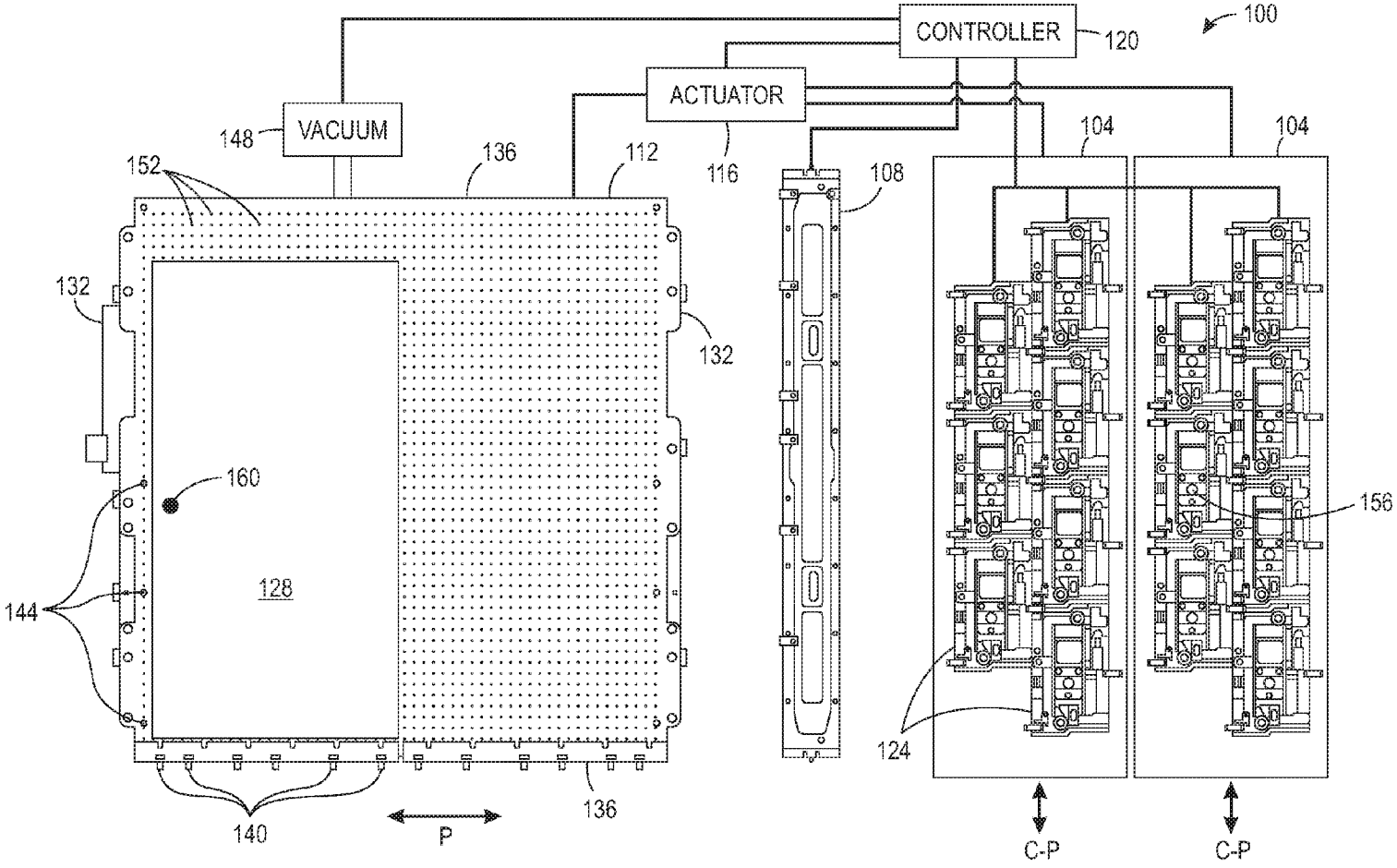
FIG. 1 is a diagram of a system that enables registration of printheads in a printer.

For a general understanding of the present embodiments, reference is made to the drawings. In the drawings, like reference numerals have been used throughout to designate like elements.

FIG. 1 depicts a printing system that accurately registers ejected material on planar members in the printing system. The system 100 includes two arrays of printheads 104, a full-width optical imaging device 108, a planar member 112, one or more actuators 116, and a controller 120 that is operatively connected to the actuators 116, the printheads 124 in the arrays 104, and the optical imaging device 108. Each of the depicted printhead arrays 104 is configured with two rows of printheads 124 that are stitched in a known manner to enable a continuous line to be printed across media carried by the planar member 112. The printheads are configured to eject material drops at a predetermined number of drops per linear unit of measurement. For example, in one embodiment, the printheads in each array eject ink drops to form the continuous line across the media at a resolution of 300 drops per inch (dpi). The two arrays can be offset from one another across the width of the media by a distance that corresponds to one-half of the distance between adjacent nozzles in the printheads. This arrangement doubles the resolution of the continuous line that the arrays can form across media on the planar member 112. For example, if each of the two arrays can form a line across the media at a resolution of 300 dpi, then offsetting the two arrays by one-half of the distance between adjacent nozzles in the printheads produces a resolution of 600 dpi for the continuous line formed by the two arrays across the media.

The optical imaging device 108 can be implemented with a linear array of photodetectors and a light source that extends the length of the linear array of photodetectors. The light source is oriented to direct light onto the media 128 on the planar member 112 as the controller 120 operates at least one actuator 116 to move the planar member from a position beneath the printhead arrays 104 to the position shown in FIG. 1. This direction of movement is called the process direction P in this document and the axis orthogonal to this movement direction in the plane of the media is called the cross-process direction C-P in this document. The directed light is reflected by the media 128 and material drops ejected onto the media 128 by the printheads 124 of the arrays 104. Bare media reflects more of the light into the photodetectors and the ejected material drops absorb more of the light. The photodetectors generate electrical signals corresponding to the intensity of the light received by the photodetectors. Thus, photodetectors that receive light reflected from bare media generate electrical signals with a greater amplitude than the photodetectors that receive light that is absorbed by the ejected material drops. This contrast in electrical signal amplitude enables the controller 120, which receives the electrical signals from the optical imaging device 108, to analyze the signals to identify positions of ejected material drops on the media as well as the positions of fiducial marks on the planar member 112.

The planar member 112 includes two edges 132 that are parallel to the cross-process direction and two edges 136 that are parallel to the process direction. One of the edges 136 is populated with a plurality of pins 140 that form a registration edge for the media sheet 128. Similarly, the edge 132 that is a leading edge when the planar member 112 moves in the process direction from the printheads to the optical imaging device 108 is populated with at least three pins 144 to form a registration edge for a lead edge of the media sheet 128. These pins 140 and 144 enable a media sheet 128 to be positioned on the planar member 112 at a known position so image data generated by the optical imaging device 108 of ejected material drops on the media sheet 128 can be correlated to the known positions of the pins 140 and 144. This information enables the controller 120, which operates at least one printhead 124 to eject material drops onto the media sheet 128, to analyze the image data to identify whether the ejected material drops are located where they are expected to be on the media sheet. If they are not, the controller 120 identifies the process direction error distance and the cross-process direction error distance of the ejected material drops to enable correction of the printhead cross-process positions and the timing of the signals to the printheads that operate the ejectors in the printheads to eject material drops. In the embodiment shown in FIG. 1, the planar member 112 is configured with an array of apertures through the planar member that are arranged to be equidistant from adjacent apertures in both the process and cross-process directions. The rows are parallel to the process direction and the columns are parallel to the cross-process direction. These apertures 152 are pneumatically connected to a vacuum source 148 to draw a vacuum through the apertures. When a media sheet 128 is positioned on the planar member 112 and the vacuum source 148 is activated, the media sheet 128 is held against the planar member 112 by the action of the vacuum on the sheet.

In one embodiment of a method that operates the system 100 to register the positions of the printheads 124 in the arrays 104, one printhead is designated a reference printhead 156. The reference printhead 156 can be any printhead in any array, but a centrally located printhead in the arrays is preferred. The controller 120 operates the reference printhead 156 to eject a predetermined number of material drops to form a collection of material drops on the media sheet 128 that has a relatively large diameter. Imaging device 108 generates image data of this circular collection of material drops 160, the media sheet 128, and the planar member 112 as the controller 120 operates the actuators 116 to move the planar member 112 from being beneath the printheads 124 to the position shown in FIG. 1. The controller 120 receives the image data from the imaging device 108 and analyzes the image data to identify the cross-process direction error distance and process direction error distance of the material circle 160.

Figure 2:
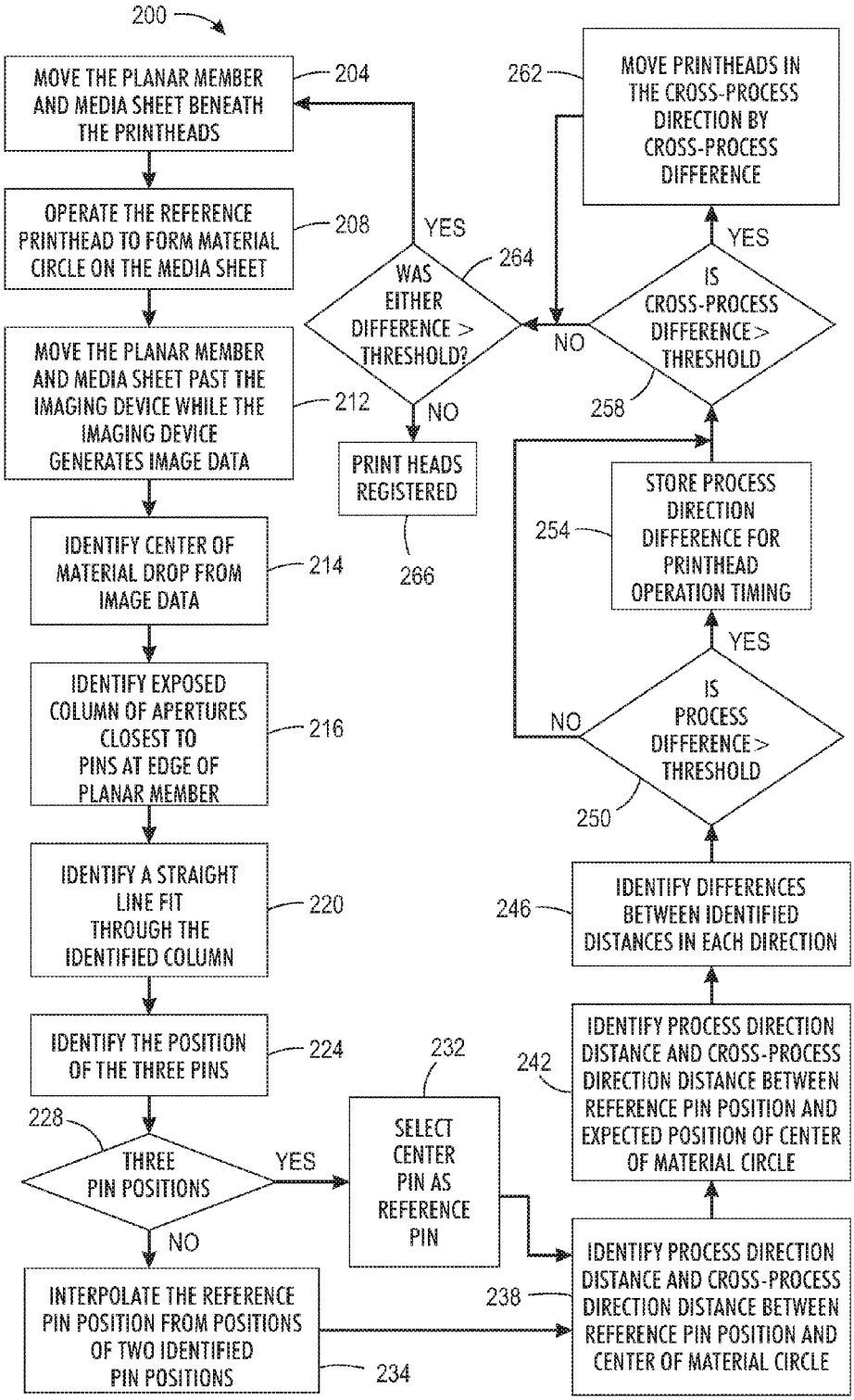
FIG. 2 is a flow diagram of a process for operating the system of FIG. 1.

A process 200 for producing the material circle 160 and analyzing the image data of the circle on the media and planar member is shown in FIG. 2. In the description of this process, statements that the process is performing some task or function refers to a controller or general purpose processor executing programmed instructions stored in a memory operatively connected to the controller or processor to manipulate data or to operate one or more components in the printer to perform the task or function. The controller 120 noted above can be such a controller or processor. Alternatively, the controller 120 can be implemented with more than one processor and associated circuitry and components, each of which is configured to form one or more tasks or functions described herein.

Figure 3:
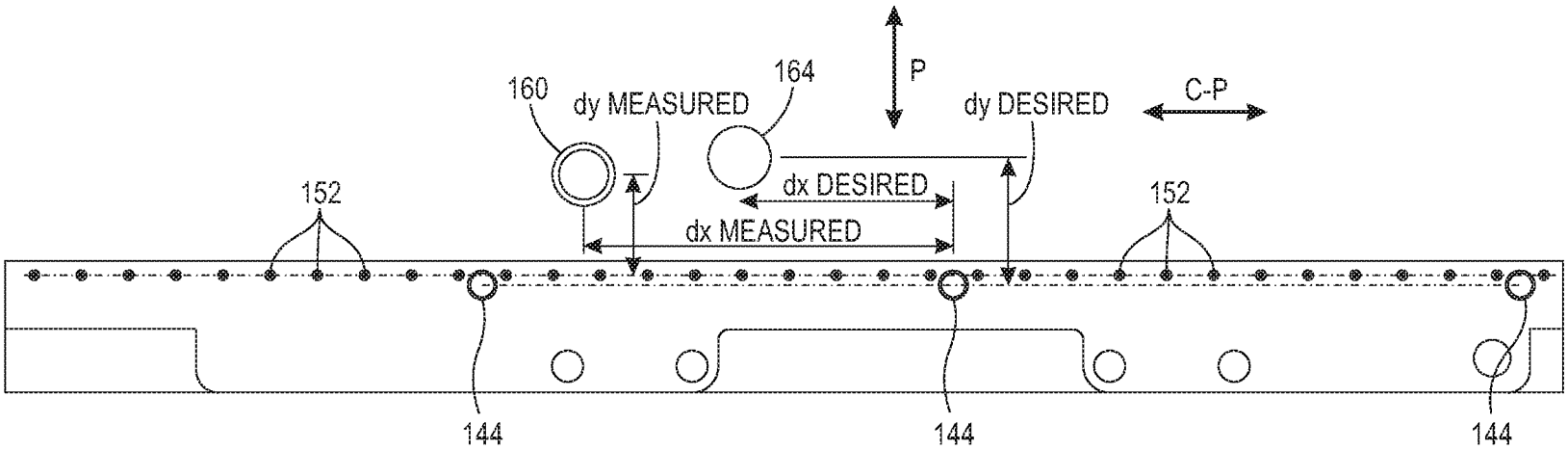
FIG. 3 illustrates the spatial relationships between structural and printed features in the system of FIG. 1.

The operator positions the media sheet 128 on the planar member 112 so one edge of the media sheet covers the next-to-last column of apertures 152, but leaves the column of apertures adjacent to the pins 144 exposed. The edge of the media sheet perpendicular to the leading edge of the media sheet covers a portion of the row of apertures 152 adjacent the pins 140. The controller 120 activates the vacuum source 148 to hold the media sheet 128 against the planar member 112 while the registration process is performed. Once the position of the media sheet is fixed, the controller 120 operates the actuators 116 to move the planar member 112 beneath the printheads 124 (block 204). The position of the media sheet enables the controller 120 to operate the reference printhead 156 to form the material circle 160 near the edge of the media sheet 128 close to the pins 144 and approximately in the middle of the media sheet in the cross-process direction (block 208). The controller 120 then operates the actuators 116 to move the planar member 112 past the imaging device 108, while the imaging device 108 generates image data of the media sheet 128 on the planar member 112 (block 212). The controller 120 processes the image data received from the imaging device 108 to identify a center of the material drop 160 (block 214). This identification is made by identifying a cluster of darker pixels in the image data that form a nearly circular shape having a predetermined size that is within a predetermined radial tolerance. The controller identifies the column of apertures 152 exposed between the pins 144 and the edge of the media sheet 128 closest to the pins (block 216). This identification includes eliminating any candidate apertures that are not within a predetermined distance of the pins 144 in the process direction. The controller 120 identifies a straight line fit through the image data locations identified as apertures 152 (block 220). The controller 120 processes the image data received to identify the three pins 144 (block 224). This identification is made by identifying a cluster of darker pixels in the image data that form a nearly circular shape having a predetermined size that is within a predetermined radial tolerance. This identification also includes eliminating any candidate pin positions that are not within a predetermined distance of the straight line and those candidate pin positions that are not within a predetermined distance from one another in the cross-process direction. If all three pins 144 are identified (block 228), then the center pin position is selected as a reference point for measuring distances to the material drop 160 (block 232). If only two pins 144 are identified, then an interpolation is made with reference to the distances between the two pins to identify the reference point for measuring distances to the material drop 160 (block 234). From the identified reference point, the controller 120 measures a distance in the process direction between the reference point and material drop 160 and a distance in the cross-process direction between the reference point and the material drop 160 (block 238). From the identified reference point, the controller 120 measures a distance in the process direction between the reference point and an expected position 164 for the material drop and a distance in the cross-process direction between the reference point and the expected position 164 for the material drop 160 (block 242). The relationships between these positions and distances are shown in FIG. 3. The controller 120 identifies differences between the distances measured for the material drop 160 and its expected position in both the process and cross-process directions (block 246). The process direction difference is compared to a predetermined threshold (block 250), and if it is greater than the threshold, then it is stored for use to correct the timing of the printhead firing (block 254). Likewise, the cross-process direction difference is compared to a predetermined threshold (block 258), and if it is greater than the threshold, then the controller 120 uses the difference in the cross-process direction to operate the actuators 116 to adjust the positions of the printhead arrays in the cross-process direction (block 262). If neither difference is greater than their respective thresholds, the printhead arrays are identified as being in registered positions (block 266). If either difference exceeded its threshold, then the process is repeated until the printheads are considered to be registered.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printing system comprising:

a plurality of printheads, each printhead being configured to eject drops of material;

a planar member having at least three pins along a first edge of the planar member and a plurality of pins on a second edge of the planar member that is orthogonal to the first edge;

a plurality of actuators operatively connected to the printheads and to the planar member to enable the actuators to move the planar member bi-directionally in a process direction with reference to the plurality of printheads and to move the printheads bi-directionally in a cross-process direction;

an optical imaging device configured to generate image data of the planar member as the planar member passes the optical imaging device; and a controller operatively connected to the plurality of printheads, the optical imaging device, and the actuators, the controller being configured to operate one of the actuators to move the planar member past the array of printheads and to operate one of the printheads in the plurality of printheads to eject drops of material onto a media sheet that has one edge against the plurality of pins on the second edge of the planar member and has another edge that is adjacent the one edge of the media sheet and proximate the first edge of the planar member as the planar member passes the printheads to form a collection of material drops having a circular shape on the media sheet, to receive image data of the planar member and the media sheet from the optical imaging device as the planar member and media sheet pass the optical imaging device, to identify from the image data received from the optical imaging device positions for the collection of material drops and for at least two of the pins on the first edge of the planar member, and to identify a process direction error distance and a cross-process direction error distance with reference to the positions for the collection of material drops and the at least two pins on the first edge of the planar member.

2. The system of claim 1, the controller being further configured to:

identify a center of the collection of material drops;

identify a position for a reference pin from the identified positions for the at least two pins; and identify a distance between the identified center of the collection of material drops and the identified position for the reference pin.

3. The system of claim 2, the controller being further configured to:

identify a size of the collection of material drops;

compare the identified size of the collection of material drops to a predetermined range; and identify the collection of material drops in response to the identified size being within the predetermined range.

4. The system of claim 2, the controller being further configured to:

identify the position of the reference pin by interpolating between the identified position of the at least two pins.

5. The system of claim 2, the controller being further configured to:

identify a center position for where the collection of material drops is expected; and identify a distance between the identified center position where the collection of material drops is expected and the identified position for the reference pin.

6. The system of claim 5, the controller being further configured to:

identify the distance between the identified center of the collection of material drops and the identified position for the reference pin as a distance in the process direction and a distance in the cross-process direction;

identify the distance between the identified center position where the collection of material drops is expected and the identified position for the reference pin as a distance in the process direction and a distance in the cross-process direction;

identify the process direction error distance as a difference between the identified distance between the identified center of the collection of material drops and the identified position for the reference pin in the process direction and the identified distance between the identified center position where the collection of material drops is expected and the identified position for the reference pin in the cross-process direction; and identify the cross-process direction error distance as a difference between the identified distance between the identified center of the collection of material drops and the identified position for the reference pin in the cross-process direction and the identified distance between the identified center position where the collection of material drops is expected and the identified position for the reference pin in the cross-process direction.

7. The system of claim 6, the controller is further configured to:

compare the cross-process direction error distance to a predetermined threshold; and operate one of the actuators to move the array of printheads in the cross-process direction a distance corresponding to the cross-process direction error distance in response to the cross-process direction error distance being greater than the predetermined threshold.

8. The system of claim 6, the controller is further configured to:

compare the process direction error distance to a predetermined threshold; and operate the printheads to eject material drops with reference to the process direction error distance in response to the process direction error distance being greater than the predetermined threshold.

9. The system of claim 1, the planar member further comprising:

a plurality of apertures in the planar member, the apertures being arranged in rows and columns with the rows being parallel to the process direction and the columns being parallel to the cross-process direction;

a vacuum source operatively connected to the apertures in the planar member, the vacuum source being configured to pull a vacuum through the apertures in the planar member to hold the media sheet against the planar member; and the controller being operatively connected to the vacuum source to operate the vacuum source and hold the media sheet against the planar member once the one edge of the media sheet is against the plurality of pins on the second edge of the planar member and the other edge of the media sheet that is adjacent the one edge of the media sheet is positioned at the first edge of the planar member to expose a column of apertures between the other edge of the media sheet and the three pins on the first edge of the planar member and cover a next column of apertures in the process direction, the controller being further configured to:

identify positions for the apertures in the column of exposed apertures;

identify a straight line through the positions for the column of exposed apertures; and identify the positions for the at least two pins with reference to the identified straight line.

10. A method of operating a printing system comprising:

operating with a controller one of a plurality of actuators to move a planar member past an array of printheads;

operating with the controller one of a plurality of printheads to eject drops of material onto a media sheet that has one edge against a plurality of pins on a first edge of the planar member and has another edge that is adjacent the one edge of the media sheet and proximate a second edge of the planar member that is adjacent to the first edge of the planar member as the planar member passes the array of printheads to form a collection of material drops having a circular shape on the media sheet;

generating image data of the planar member and the media sheet with an optical imaging device;

receiving with the controller image data of the planar member and the media sheet from the optical imaging device as the planar member and media sheet pass the optical imaging device;

identifying with the controller positions for the collection of material drops and for at least two pins on the second edge of the planar member that is parallel to the cross-process direction; and identifying with the controller a process direction error distance and a cross-process direction error distance with reference to the positions for the collection of material drops and the at least two pins on the second edge of the planar member.

11. The method of claim 10 further comprising:

identifying with the controller a center of the collection of material drops;

identifying with the controller a position for a reference pin from the identified positions of the at least two pins; and identify with the controller a distance between the identified center of the collection of material drops and the identified position for the reference pin.

12. The method of claim 11 further comprising:

identifying with the controller a size of the collection of material drops;

comparing with the controller the identified size of the collection of material drops to a predetermined range; and identifying with the controller the collection of material drops in response to the identified size being within the predetermined range.

13. The method of claim 11 further comprising:

identify with the controller the position of the reference pin by interpolating with the controller between the identified positions of the at least two pins.

14. The method of claim 11 further comprising:

identifying with the controller a center position for where the collection of material drops is expected; and identifying with the controller a distance between the identified center position where the collection of material drops is expected and the identified position for the reference pin.

15. The method of claim 14 further comprising:

identifying with the controller the distance between the identified center of the collection of material drops and the identified position for the reference pin as a distance in the process direction and a distance in the cross-process direction;

identifying with the controller the distance between the identified center position where the collection of material drops is expected and the identified position for the reference pin as a distance in the process direction and a distance in the cross-process direction;

identifying with the controller the process direction error distance as a difference between the identified distance between the identified center of the collection of material drops and the identified position for the reference pin in the process direction and the identified distance between the identified center position where the collection of material drops is expected and the identified position for the reference pin in the process direction; and identifying with the controller the cross-process direction error distance as a difference between the identified distance between the identified center of the collection of material drops and the identified position for the reference pin in the cross-process direction and the identified distance between the identified center position where the collection of material drops is expected and the identified position for the reference pin in the cross-process direction.

16. The method of claim 15 further comprising:

comparing with the controller the cross-process direction error distance to a predetermined threshold; and operating with the controller one of the actuators to move the array of printheads in the cross-process direction a distance corresponding to the cross-process direction error distance in response to the cross-process direction error distance being greater than the predetermined threshold.

17. The method of claim 15 further comprising:

comparing with the controller the process direction error distance to a predetermined threshold; and operating with the controller the printheads in the array of printheads to eject material drops with reference to the process direction error distance in response to the process direction error being greater than the predetermined threshold.

18. The method of claim 10 further comprising:

operating with the controller a vacuum source operatively connected to a plurality of apertures arranged in rows and columns in the planar member with the rows being parallel to the process direction and the columns being parallel to the cross-process direction to hold the media sheet against the planar member once the one edge of the media sheet is against the plurality of pins on the first edge of the planar member and the other edge of the media sheet that is adjacent the one edge of the media sheet is positioned at the second edge of the planar member to expose a column of apertures between the other edge of the media sheet and the three pins on the first edge of the planar member and cover a next column of apertures in the process direction;

identifying with the controller positions for the apertures in the column of exposed apertures;

identifying with the controller a straight line through the positions for the column of exposed apertures; and identifying with the controller the positions for the at least two pins with reference to the identified straight line.

* * * * *